US005989166A

United States Patent [19]

Capizzo et al.

[11] Patent Number: 5,989,166

[45] Date of Patent: Nov. 23, 1999

[54] ADJUSTABLE BARBELL PRESS APPARATUS

[75] Inventors: Kevin Capizzo, Sterling Heights; Frank Capizzo, Clinton Twp., both of Mich.

[73] Assignee: Concepts 2000, Inc., Sterling Heights, Mich.

[21] Appl. No.: 08/888,780

[22] Filed: Jul. 7, 1997

Related U.S. Application Data

[63] Continuation-in-part of application No. 08/557,715, Nov. 13, 1995, abandoned.

[51] Int. Cl.[6] ..... A63B 21/078

[52] U.S. Cl. ..... 482/104; 482/93; 482/1

[58] Field of Search ..... 482/104, 106, 482/1, 4, 5, 6, 93

[56] References Cited

U.S. PATENT DOCUMENTS

| | | | |
|---|---|---|---|
| 1,239,524 | 9/1917 | Root . | |
| 4,216,959 | 8/1980 | Niles | 482/104 |
| 4,253,662 | 3/1981 | Podolak . | |
| 4,256,301 | 3/1981 | Goyette . | |
| 4,355,633 | 10/1982 | Heilbrun | 482/903 X |
| 4,471,956 | 9/1984 | Marlo . | |
| 4,709,922 | 12/1987 | Slade, Jr. et al. . | |
| 4,799,672 | 1/1989 | Barrett . | |
| 4,799,673 | 1/1989 | Selle . | |
| 4,807,875 | 2/1989 | Tanski . | |
| 4,815,746 | 3/1989 | Ward, Jr. . | |
| 4,875,676 | 10/1989 | Zimmer . | |
| 4,949,959 | 8/1990 | Stevens . | |
| 4,998,721 | 3/1991 | Anders et al. . | |
| 5,141,480 | 8/1992 | Lennox et al. | 482/104 |
| 5,190,510 | 3/1993 | Goodger | 482/104 |
| 5,217,421 | 6/1993 | Chrysler . | |
| 5,273,506 | 12/1993 | Dawson, Jr. . | |
| 5,281,193 | 1/1994 | Colbo, Jr. . | |
| 5,290,213 | 3/1994 | Shiekowitz | 482/104 |
| 5,306,220 | 4/1994 | Kearney | 482/94 |
| 5,310,394 | 5/1994 | Kallios | 482/104 |
| 5,407,403 | 4/1995 | Coleman | 482/104 X |

*Primary Examiner*—John Mulcahy

[57] ABSTRACT

An adjustable, portable apparatus for assisting weight lifters to safely perform barbell press exercises to muscular failure and assist in a forced repetition is disclosed. The apparatus includes two spaced vertically telescoping stanchions with upper ends for allowing adjustment between a minimum length position and a maximum length position of the stanchions. The apparatus further includes a cantilevered member extending horizontally from each of the stanchion upper ends and a member horizontally interconnecting the cantilevered members which allows adjustment between a minimum width position and a maximum width position of the apparatus. A lifting system is operatively interconnected to the horizontal member and a barbell that allows selectable incremental vertical lifting and lowering distance during exercise. A control system including a safety switch for actuating the lifting system to vertically lift and lower the barbell is provided. A backup safety system is provided.

8 Claims, 2 Drawing Sheets

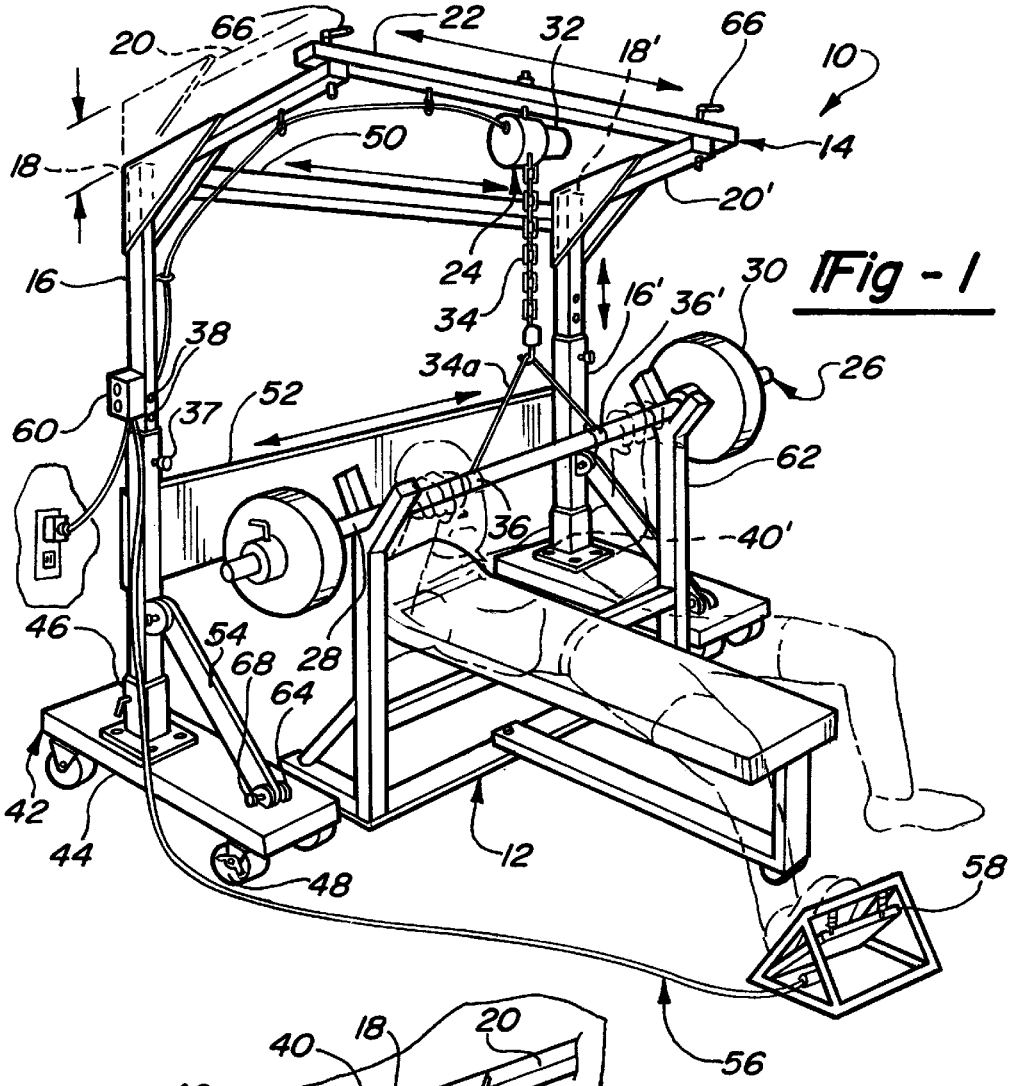
Fig - 1
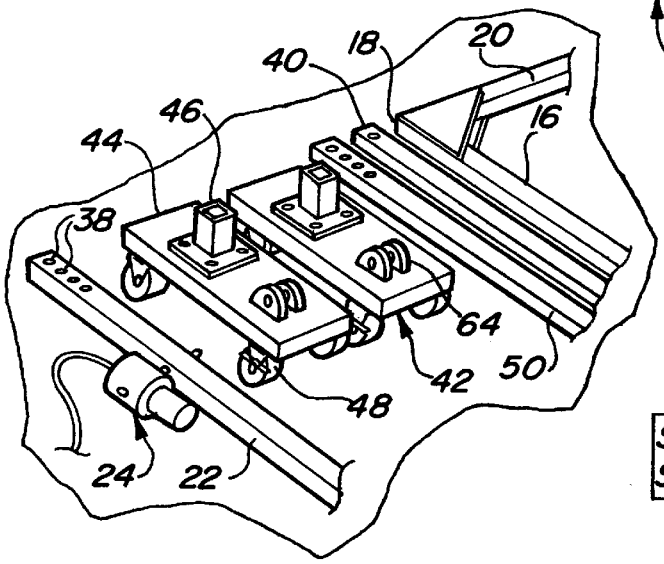
Fig - 2
Fig - 3
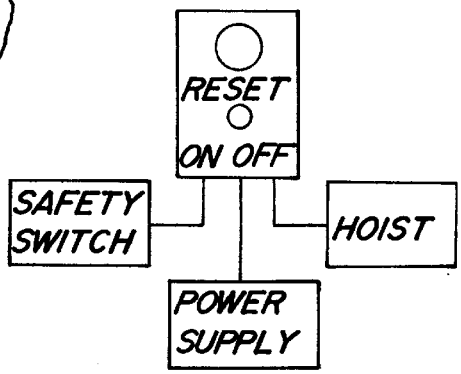

ADJUSTABLE BARBELL PRESS APPARATUS

This application is a Continuation-In-Part of U.S. Ser. No. 08/557,715, filed Nov. 13, 1995, and now abandoned.

TECHNICAL FIELD

The invention relates to exercise apparatus, specifically to a weight lifting safety apparatus for selectively and incrementally raising and lowering barbells which can also be adjusted to fit any style and size of weight bench or room size.

BACKGROUND OF THE INVENTION

Barbell pressing exercises generally involve a weight lifter lying or sitting on a bench. A weighted barbell is supported above the weight lifter at arms length by vertical support posts connected to the bench. The weight lifter performs the exercise by removing the barbell from the support posts, then lowers it to the torso and presses it back to arms length. This lowering and pressing movement, lifting cycle, is repeated until the weight lifter is fatigued but can still press the barbell to arms length and place it back onto the support posts. At this point, the weight lifter has completed one set of the barbell pressing exercise.

However, this exercise can be hazardous if the weight lifter is over fatigued and cannot completely press the barbell a final time to place it back on the support posts. The weight lifter is then effectively trapped under the barbell and, without assistance, could be severely injured. Therefore, weight lifters usually require the use of a "spotter" that is, a second person to assist in lifting the barbell and returning it to the support posts after the weight lifter has become over-fatigued.

Typically, the spotter not only makes sure the weight is safely returned to the support posts but also assist in a "forced repetition" (see U.S. Pat. No. 5,407,403 for a description of "forced repetition exercises"). Briefly, with the assistance of the spotter the weight lifter will go through several more lifting cycles beyond the point of fatigue. In general, the spotter is used at all points during the cycle and often is needed at the initiation of the lifting cycle for forced repetitions. The weight lifter is able to start the lift and then finds that he/she cannot continue. Without the spotter the weight would fall back to the torso. The spotter then helps the weight lifter continue the lift from the "failure" point. The spotter can also assist in lowering the barbell to complete the cycle. The exact point in the cycle where the lifter will "fail" will differ with each exercise session.

In other words, a spotter will enable the weight lifter to perform a forced repetition by giving extra lifting assistance when the weight lifter is at the "sticking point" (failure). The sticking point is actually a range of motion of the lifting cycle that usually begins when the weight lifter is fatigued and the barbell is just above the weight lifter's torso and the arms are drawn fully back. In this position, the pectoral and tricep muscles are at a physical disadvantage and cannot be fully utilized to press a heavy barbell. The sticking point range of motion assistance continues until the weightlifter's arms are extended upward and his/her pectoral and tricep muscles can generate enough force to finish pressing the barbell unassisted. The ideal spotter will only give lift assistance through the sticking point range of motion. This range can vary incrementally anywhere from the weight lifter's torso to one inch or more from the torso or in the event of a muscle or tendon tear the entire distance to the support posts.

The weight lifter's sticking point range of motion where lifting assistance is required depends on many factors such as food intake and fatigue. For these reasons, the optimum incremental amount of spotter assistance for a forced repetition will vary from set to set and cannot be accurately predicted or predetermined. In addition to assisting with a forced repetition, a spotter is also required to prevent the barbell from falling freely back onto the weight lifter in the event of excessive fatigue.

Unfortunately, a spotter is not always available on a consistent basis. For this reason, the weight lifter often performs the exercise without a spotter and takes a chance on being able to complete the last repetition unassisted. This action can lead to injury. In effect then this limits the time and places in which bench press exercising can be safely undertaken.

Bench press equipment often includes a pair of vertical bars with notches to hold the barbell weight in-between exercise sessions. However, this type of apparatus does not provide any means for the removal of the barbell away from the weight lifter without the necessity of the user lifting the barbell onto the notches. U.S. Pat. Nos. 5,407,403, 5,310,394, 5,273,506, 5,281,193, 5,217,421, 5,190,510, 5,141,480, 4,949,959, 4,998,721, 4,875,676, 4,815,746, 4,807,875, 4,799,673, 4,799,672, 4,709,922, 4,471,956, 4,256,301 and 4,253,622 provide apparatus and devices to provide safety assistance to the weight lifter and/or means for forced repetitions without a "spotter".

However, these devices are generally not adjustable, that is they are not designed to generally fit, or include as part of the apparatus, any flat style of bench and any size of barbell. There are also incline, decline and seated benches which are not accommodated by these devices. There are varying sizes of barbells and weight benches which are not accommodated by the above-listed devices. Typically, commercial gyms use an Olympic size barbell which requires standard width benches while home use barbells generally are shorter and utilize smaller width benches. However, today many home gyms also use the Olympic size barbells as well. In addition, non bench weight lifting, i.e., free standing barbell exercises such as squats or standing shoulder presses also have the same safety considerations. Further, the equipment is generally designed for gym use with the higher ceilings found in a gym rather than the home.

Further, several of these devices only provide "lift" assistance to rescue the weight lifter when pinned by the barbell and generally they lift the distance to the height necessary for storage of the barbells. For example, this type is shown in U.S. Pat. Nos. 4,253,662 and 4,471,956. These devices do not provide for the use of the device in forced repetitions as described herein above. These types of device do not allow for assisting in the lowering part of the cycle if needed and there is no control on how much vertical distance the barbell is lifted when activated. The distance is preset and as described herein above the range of motion (sticking point) cannot be predicted for a given set of exercises. Therefore a spotter device is needed that is adjustable during the exercise activity, that is the vertical distance can be selected as needed during exercise.

Devices are disclosed as shown in U.S. Pat. No. 4,949,959 that do provide a raising and lowering mechanism. However, in this device the amount of vertical distance that the barbell is lifted is also preset prior to the start of the exercise. There is no selectivity during the exercise as to how much lift is provided and again the vertical lift distance is preset.

It would be useful to have one portable apparatus that has the necessary safety features, that can be used for forced repetitions with selectivity as to vertical lift distance and that can also be adjusted to fit any style of bench or alternatively for free standing barbell exercises and also can be adjusted for room size and/or available floor space. This would enable an individual weight lifter to only change bench styles in order to change the type of weight lifting exercise undertaken, which would be a considerable cost saving. Further, gym owners would only have to have one type of apparatus and as demand for different styles of benches change, they would only have to change the bench, not the safety/forced repetition apparatus. Also, if the benches are permanently attached to the floor, the portable apparatus could be moved from bench to bench as desired. In addition, it would be less costly for gym owners to be able to use their current benches and not have to purchase safety equipment which includes a bench.

Additionally, it would be useful to have an apparatus that is compact and can be easily stored. In both the gym and the home there is generally limited space for equipment, both for use and for storage. In the gym, the owner needs to have as many benches set up as possible, thereby limiting the space between benches. This in turn limits the size of the apparatus that has the necessary safety features and that can be used for forced repetitions without a spotter. Similarly in the home there is generally limited space for such equipment. Further, often in the home the equipment must be stored and must therefore be easy to assemble/disassemble and store.

SUMMARY OF THE INVENTION AND ADVANTAGES

According to the present invention, an adjustable exercise apparatus for assisting weight lifters to safely exert maximum effort and for forced repetition assist is disclosed. The apparatus includes two spaced vertically telescoping stanchions with upper ends for allowing adjustment between a minimum length position and a maximum length position of the stanchions. The apparatus further includes a cantilevered member extending horizontally from each of the stanchion upper ends and members horizontally interconnecting the cantilevered members and stanchions which allow adjustment between a minimum width position and a maximum width position of the apparatus. A lifting system is operatively interconnected to the horizontal member and a barbell and allows selectable incremental vertical movement of the barbell during use. A control system including a safety switch for actuating the lifting system to vertically selectively incrementally lift or lower the barbell during exercise is provided.

In a further embodiment the present invention provides an additional set of safety chains as a backup safety system and means for preventing the chains from interfering with the use of the exercise equipment.

The present invention therefore provides one apparatus that has the necessary safety features including a backup safety system, that can be used for forced repetitions and that can adjust to fit any style of bench and/or room while being compact, portable and easily assembled and/or disassembled for storage. Several of the previous patents, such as U.S. Pat. Nos. 5,407,403 and 4,949,959 require the use of complicated computer and/or lifting mechanisms which could be very costly to manufacture. Nor do the prior art patents provide a backup safety system, rather they depend on the lift means only. However, the disclosed apparatus does not require such complex systems, does provide a backup safety system and would therefore, be more affordable, easier to ship and assemble, and simpler and safer to use.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of a first embodiment of the invention;

FIG. 2 is a partial view showing the apparatus of the present invention in disassembled form;

FIG. 3 is a schematic view of the control circuit of the present invention;

DETAILED DESCRIPTION OF THE PREFERRED EMBODIMENT

Figure 4:
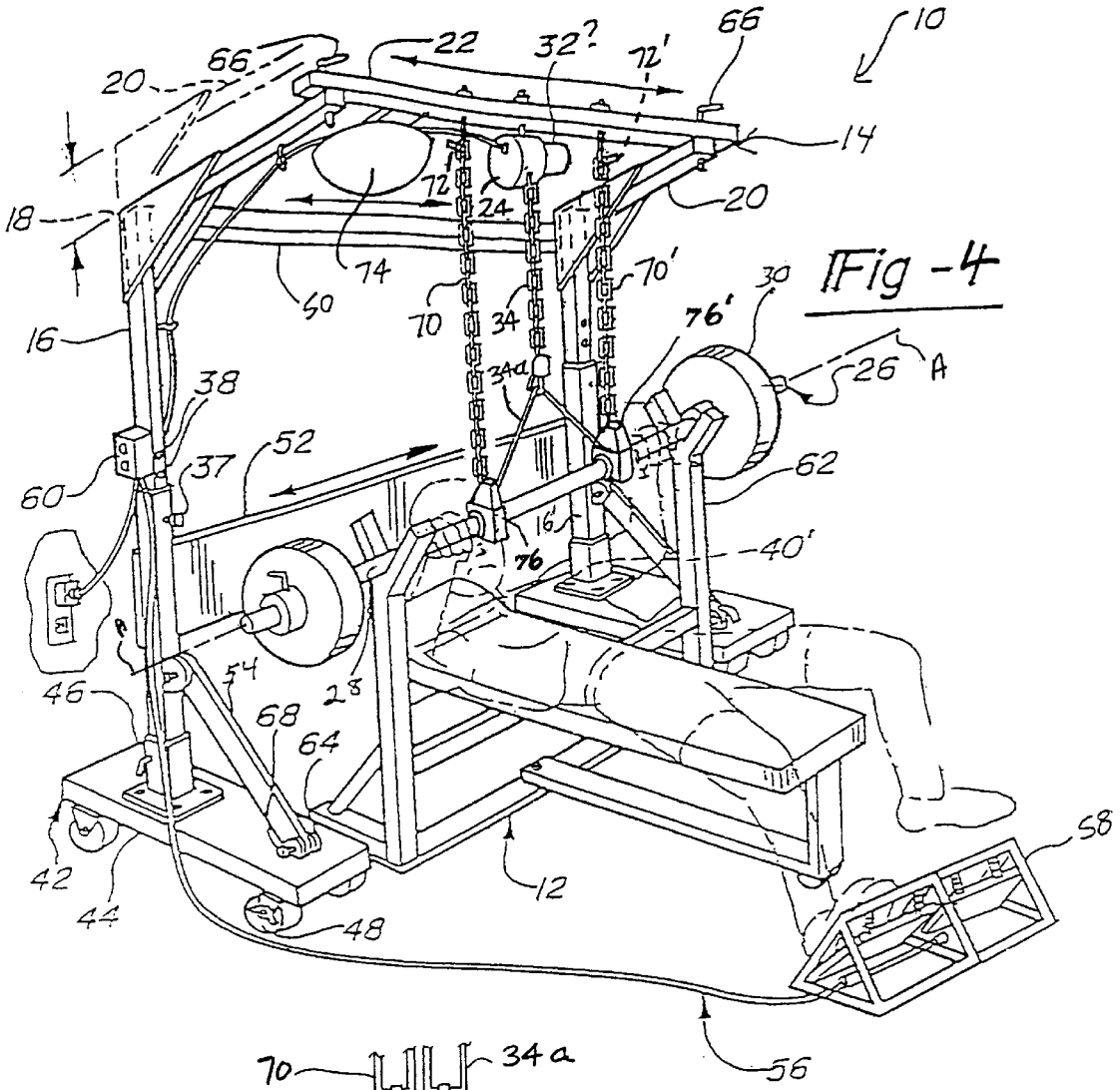
FIG. 4 is a perspective view of a second embodiment of the invention.

The present invention, as shown in FIGS. 1–5, is an adjustable bench press apparatus, generally shown at 10, for assisting weight lifters to safely exert maximum effort and for forced repetition assist without the necessity of a spotter.

The term adjustable as used herein refers to the ability of the apparatus to be adapted in size and configuration to fit the style weight bench used and the room dimensions or available floor space. The term is also used to refer to the ability select the amount of vertical lift or lowering distance provided by the present invention, that is the device can be adjusted during use to select the amount of lift in any increment that is required to get through the "sticking point".

The bench press apparatus 10 is adjustable to fit any flat weight bench, generally shown at 12 and can also be used with any incline, decline and seated barbell weight bench or alternatively without a bench. The bench press apparatus 10 includes a frame, generally shown at 14, which can support the weights used and which includes two spaced vertically telescoping stanchions, 16, 16', each with an upper end 18, 18' for allowing adjustment between a minimum length position and a maximum length position (see FIG. 1) of the stanchions 16, 16'. That is the height of the stanchions 16, 16' can be adjusted to accommodate any style bench, whether flat, incline, decline and seated style or a free-standing weight lifter.

A cantilevered member 20, 20' extends horizontally from each of the upper ends, 18, 18', and is interconnected by a horizontally adjustable member 22 which allows adjustment between a minimum width position and a maximum width position. That is the width between the stanchions 16, 16' can be adjusted to accommodate any width bench or barbells (see FIG. 1).

Further, the horizontally adjustable member 22 and two spaced vertically telescoping stanchions, 16, 16' can also be adjusted to accommodate differing ceiling heights and available floor space for the equipment.

Attached to the horizontally adjustable member 22 is a lift means for raising and lowering the barbells, generally shown at 24, which is operatively interconnected to the horizontal member 22 and a barbell, generally shown at 26, which includes a bar 28 and weights 30. Any lift means 24 that provide selectable incremental vertical lift or lowering distance is used. In a preferred embodiment a hoist is used since such control is inherent in a hoist. A hoist 32 is shown in FIGS. 1 and 4 and a chain 34 interconnectedly attached to the hoist 32 and the barbell 26. In general, any hoist that can support weight in the range up to 1000 pounds can be used. In a preferred embodiment the hoist is a Little Mule Products ¼ ton model ¼SS-1A. A ½ ton model ½SS-1A can be used for a 1000 pound limit. Alternatively a Coffing Hoist ELC 1016 can be used. The lift means 24 can include a pulley system to increase the efficiency.

Supports 34 and 34*a* are either chain, cable or material as known in the art that can support the full range of weights that are being used. The support 34 extends from the hoist and either divides to attach directly to the barbell 26 in at least two positions, 36, 36', on the bar 28 as described hereinbelow or attaches to a second support 34*a* which attaches to the barbell 26 at two positions 36, 36'. The support cable or chain 34 or 34*a* is attached to the barbell 26 in-between and spaced from the weights 30 at either end of the barbell 26. The attachment points 36, 36' are selected so as not to interfere with hand positioning on the bar 28 and so as not to interfere with adding or removing of the weights 30 and not interfere with placement on the support posts. Collars or other means known in the art can be attached to the barbell at the attachment points 36, 36' to facilitate connecting the cable 34 or 34*a* to the barbell. Further, as described herein below couplings 76, 76' can be used in an embodiment as shown in FIG. 4 to interconnect safety chains 70, 70' between the barbell 26 and the frame 14.

In an embodiment, the frame 14 can be made from steel tubing with evenly spaced holes along the entire length for adjustment in a selected adjusted position, either vertically for stanchion 16, 16' height adjustment or horizontally (horizontally adjustable members 22, 50, 52) to adjust the width between stanchions 16, 16'. A locking pin or bolt 37 can be used to secure the desired adjustment through the aligned holes. Alternatively, holes 38 can be placed in the frame 14 at predetermined positions to allow adjustment. Other adjustment means as known in the art can be selected to allow telescoping adjustment of the stanchions 16, 16' and horizontal members 22, 50, 52. In addition, other materials such as aluminum, plastic or composites can be used to construct the frame as are known in the art, so long as they can maintain structural integrity during use.

A lower end 40, 40' of each stanchion 16, 16' is mounted in support means, generally indicated at 42, for supporting and in an embodiment also used for positioning the exercise apparatus 10. The support means 42 include a platform 44 and a receptacle 46 for receiving the lower end 40, 40' of the stanchion 16, 16'. The support means 42 in one embodiment can include locking casters 48 mounted on the underside of the platform 44 which allows positioning of the exercise apparatus 10.

For increasing stability of the frame 14 the stanchions 16, 16', are interconnected at their upper end 18, 18' with an upper horizontally adjustable stabilizing member 50. Further, the stanchions 16, 16' are generally interconnected with at least one horizontally adjustable stabilizing member 52 which is spaced from the upper 18, 18' and lower 40, 40' ends of the stanchions 16, 16'. In addition, an angled stabilizing member 54 can be utilized between the stanchion 16 and the platform 44.

Control means, as generally shown at 56 in FIG. 1 and shown schematically in FIG. 3, include a safety switch 58 for actuating the lift means 24 to vertically selectively incrementally raise or lower and a reset switch 60. The safety switch 58 can be a multipositional switch (FIG. 1) or may have separate components dedicated to raising or lowering (FIG. 4). The safety switch 58 is selected from the group consisting of mechanical, electrical, electronic, voice activated and photoelectric switches. For free standing exercises voice activated and photoelectric switches are preferred.

In use the exercise apparatus 10 is assembled by placing each stanchion 16, 16' in the platform receptacle 46 and adjusting the height of the telescoping stanchion 16, 16' to fit the type of bench 12 being used. A cantilevered member 20 is attached at right angle to the upper end 18, 18' of each stanchion 16, 16' and interconnected with a horizontally adjustable member 22 which is also telescopically adjustable to allow proper separation between the stanchions 16, 16' to fit the width of the bench 12 and/or barbells 26 being used. Additional stabilizing members 50, 52 and 54 are attached. The lift means 24 are attached to the horizontally adjustable member 22 such that it is in position over the weight lifter to perform the intended exercise. The cable 34*a* is then attached to the attachment points 36, 36' on the barbell 26.

In operation the weight lifter adjusts up or down the chain 34 to the starting position using the reset switch 60 generally mounted on one of the stanchions 16, 16'. In the starting position there is enough slack in the cable segment 34*a* to allow the weight lifter to press the barbell 26 in a totally natural, undisturbed manner.

It is contemplated that the weight lifter will press the barbell 26 to a point of muscular failure. At this point, the barbell 26 will be almost at rest on the weight lifter's torso and the chain 34 and cable segment 34*a* will be at, or almost at, full extension. The weight lifter will then activate the lift means 24 by activating the safety switch 58 which can be a mechanical, electrical or electronic foot or knee pedal, a voice activated switch or photoelectric switch. Once the lift means 24 is activated, the barbell 26 is lifted off the weight lifter. The lift means 24 will continue to lift the barbell 26 as long as the safety switch 58 is activated. The safety switch can also be used to cause the lift means 32 to lower the barbell 26 as long as the safety switch 58 is activated in the "down" position. This switch would be activated to allow multiple forced repetitions.

At this point during the exercise the weight lifter can choose to:

1. keep the lift means 24 activated only until the barbell 26 has been lifted enough past his/her "sticking point" to allow the remaining press movement to be completed unassisted (a forced repetition);
2. keep the lift means 24 activated and, at the same time, continue pressing the barbell 26 until it is safely placed back on the support posts 62 which gives a forced repetition effect due to the slow, even lifting speed of the lifting means 24; or
3. keep the lift means 24 activated and allow the lift means 24 to lift the barbell 26 with no corresponding muscular effort until the barbell is sufficiently raised to then be guided back down on the support posts using the safety switch 58 or reset switch 60 activated in the down position. This would be helpful in case of a muscle or tendon tear for example.

The exercise apparatus 10 is adapted to be collapsible for storage. As discussed herein above, the lower ends 40 of the two vertically telescoping stanchions 16, 16' are inserted in a receptacle 46 on a platform 44 during use. They are locked into place by detachable means 64 which can be removed to allow removal of the stanchions 16, 16' from the receptacle 46. Further detachable means 66 interconnect and lock the horizontally adjustable member 22 to the cantilevered members 20, 20'. The detachable means 66 can be detached to allow the horizontally adjustable member 22 to be detached from the cantilevered members 20, 20'. In like manner the lift means 24 are detachably connected to the horizontally adjustable member 20. The additional horizontally adjustable members 50, 52 and the stabilizing member 54 is likewise detachably connected. In a preferred embodiment a locking pin 68 is used.

In a further embodiment, safety chains 70, 70' are provided so that in the event of mechanical failure of the lift means 24 the safety chains 70, 70' will prevent the barbell 26 from impacting the weight lifter and causing injury. The safety chains 70, 70' are affixed to the bar 28 of the barbell 26 and interconnect with the frame 14. In a preferred embodiment, as shown in FIG. 4, the safety chains 70, 70' interconnect the bar 28 and the horizontally adjustable member 22. The length of the safety chains 70, 70' can be adjusted as necessary by the use of adjuster hooks 72, 72'. The adjuster hooks 72, 72' can be standard grab hooks or any other adjustable chain hooks that are used for suspending overhead loads that are known in the art. The safety chain 70, 70' is made of a material as known in the art that can support the full range of weights that are being used in the invention.

In an embodiment a counterweight system is contemplated to be attached to the safety chains as described herein. The safety chain 70, 70' is disposed through at least one pulley located on the upper horizontal members 22, 50 of the frame 14 and is attached to a counterweight at the opposite end. At least one of the pulleys includes a ratcheting mechanism that allows travel in one direction only. In the event of mechanical and/or electrical failure of the lift means 24 the safety chains 70, 70' would be engaged and the counterweight system activated as is known in the art. At this point the ratchet mechanism would disengage and allow the counterweight to free-fall from its suspended height. The free-fall of the counterweight, which is attached to the chain 70, would thus act as an assist for the weight lifter to raise the barbell 26 away from his/her torso so it can be safely placed back on the support posts 62.

In a further embodiment a mirror 74 can be attached to the horizontally adjustable member 22 as shown in FIG. 4. The mirror is selected and positioned so that the user can easily see the safety switch 58 when it is positioned so as not to be at eye level. For example, when the safety switch 58 is a foot pedal in use with a flat weight bench the user will be able to see the safety switch 58 in relation to their foot. Further, the mirror allows the user to select the lift or lower aspect of the safety switch 58 more easily.

Safety chains 70, 70' have two aspects that interfere with normal bench press movement. As the barbell 26 is lifted the chains 70, 70' become slack and/or bind-up or tangle and can physically impede the motion of the weight lifter and are distracting visually and often audibly to the user. Therefore, at least one coupling 76 for attaching safety chains 70, 70' and the like to the bar 28 of a barbell 26 is provided that displaces the safety chains 70, 70' in such a way that they do not impede the weight lifter. The coupling includes means that allow the coupling to rotate about the longitudinal axis A of the bar 28. The rotation means includes a center of gravity CG (shown on FIG. 5) that is offset from the longitudinal axis A of the bar 28. As the weightlifter performs the lifting cycle and the barbell 26 moves, the coupling 76 is rotated about the bar 28 longitudinal axis A such that the safety chain 70, 70' slack is displaced away from the user thereby removing it as an obstruction and distraction.

The coupling 76 is affixed to the barbell 26 such that lateral movement of the coupling is prevented as is known in the art. The attachment position 36 is selected so as to not interfere with the placement of the weight lifter's hands on the bar 28 or adding, removing weights 30 or placement on support posts 62.

Figure 5:
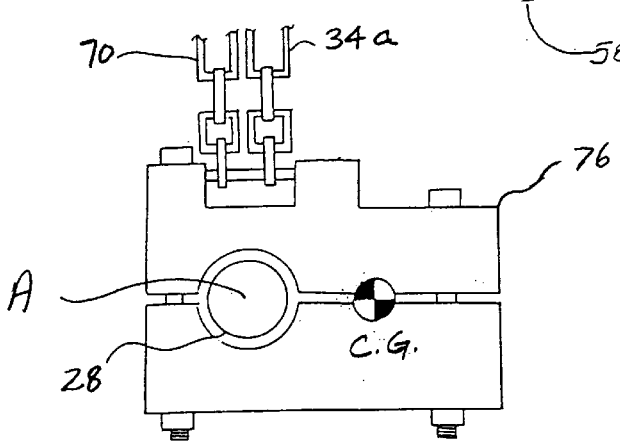
FIG. 5 is a side view of attachment collars for the safety chains and lift means of the invention.

In the embodiment as shown in FIG. 4 and FIG. 5 the coupling is an attachment collar 76, 76'. The attachment collars 76, 76' allow both the safety chains 70, 70' and lift mean chain 34*a* to be be connected to the bar 28 at attachment point 36, 36'. The attachment collars 76, 76' are disposed around the barbell as shown in FIG. 5, generally using a clamp or other means known in the art. The attachment collars 76, 76' are affixed on the bar 28 such that they cannot be laterally displaced as is known in the art. The collar 76, 76' can be in two pieces and bolted together to encompass the bar 28. Alternatively, the collars 76, 76' can be integral with the bar 28.

The present invention is a weight safety apparatus that provides a means of allowing a weight lifter to selectively and incrementally adjust the amount of vertical lift (or lowering) assistance ("spot")needed while performing an exercise. The apparatus allows the weight lifter to safely exert maximum effort and/or perform forced repetitions. During use, if the user is "pinned" by the barbell the invention provides for the following:

The user can decide to keep the lift means 24 activated only until the barbell 26 has been lifted enough as determined by the user at that point in time, that is a selectable incremental distance, to allow the remaining press movement to be completed unassisted (a forced repetition). Upon release of the activation switch 58 the barbell is held in place and does not drop back on the user and does not reverse direction or the safety switch 58 activated in the down position.

The user can keep the lift means 24 activated and, at the same time, continue pressing the barbell 26 until it is safely placed back on the support posts 62 which gives a partial forced repetition effect due to the slow, even lifting speed of the lifting means 24.

The user can keep the lift means 24 activated and allow the lift means 24 to lift the barbell 26 with no corresponding muscular effort until the barbell is sufficiently raised to then be guided back down on the support posts using reset switch 60.

The present invention further provides for vertical travel adjustment by adjusting the height of the vertically telescoping stanchions 16, 16' to accommodate any type of weight bench, or no bench. The frame adjustability also allows use of the apparatus with any room ceiling height.

Throughout this application various patents are referenced by number. The disclosures of these cited publications in their entireties are hereby incorporated by reference into this application in order to more fully describe the state of the art to which this invention pertains.

The invention has been described in an illustrative manner, and it is to be understood that the terminology which has been used is intended to be in the nature of words of description rather than of limitation, the invention may be practiced otherwise than as specifically described.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An adjustable exercise apparatus for assisting weight lifters too safely exert maximum effort and for forced repetition assist including two spaced vertically telescoping stanchions with upper and lower ends for allowing an adjustment between a maximum length position and a minimum length position of said stanchion, a cantilevered member extending horizontally from each of said upper ends, at least one horizontally adjustable member interconnecting said cantilevered members for allowing adjustment between a minimum width position and a maximum width position between said stanchions, a lift means for operatively interconnecting to said horizontal member and a barbell such that selectable incremental vertical movement of said barbell during use can be obtained, and control means for actuating said lift means to incrementally vertically move the barbell, said lift means comprising a hoist with an electric motor which is operable to advance or retract a flexible line having a free end with a device for connecting to a barbell, said control means comprising a user operable control having an up position for activating said hoist to retract said line to raise said connecting device to a selected height and a down position for activating said hoist to advance said line to lower said connecting device to a selected height, where upon release of said control from either said up position, said hoist is deactivated to hold the connecting device in place at the selected height.

2. An adjustable exercise apparatus as set forth in claim 1 wherein said hoist can support weight in a range of 1 to 1000 pounds.

3. An adjustable exercise apparatus as set forth in claim 1 wherein said control means include a safety switch for actuating said lift means, said safety switch being selected from the group consisting of mechanical, electrical, electronic, voice actuated and photoelectric switches.

4. An adjustable exercise apparatus as set forth in claim 1 wherein said stanchions include said lower end mounted in support means for positioning the exercise apparatus.

5. An adjustable exercise apparatus as set forth in claim 1 wherein said stanchions and cantilevered member and horizontal member are composed of tubing with evenly spaced holes along their entire length for adjustment in a selected adjusted position.

6. An adjustable exercise apparatus as set forth in claim 1 wherein said stanchions are interconnected with at least one horizontal stabilizing member spaced from said upper and lower ends.

7. An adjustable exercise apparatus to accommodate free standing barbell exercises or to fit any flat, incline, decline and seated barbell weight benches including two spaced vertically telescoping stanchions with upper ends for telescopic relative movement to effect a length adjustment, a cantilevered member extending horizontally from each of said upper ends, a horizontally adjustable member interconnecting said cantilevered members for width adjustment between said stanchions, a lift means operatively connected to said horizontally adjustable member and a barbell such that selectable incremental vertical movement of said barbell during use can be obtained, and control means for actuating said lift means to incrementally vertically move the barbell, said lift means comprising a hoist with an electric motor which is operable to advance or retract a flexible line having a device connecting to the barbell proximate a free end thereof, said control means comprising user a operable control having an up position for activating said hoist to retract said line to raise said connecting device to a selected height and a down position for activating said hoist to advance said line to lower said connecting device to a selected height, where upon release of said control from said up position, said hoist is deactivated to hold the barbell in place at the selected height.

8. An adjustable exercise apparatus as set forth in claim 7 wherein said control means include a safety switch, said safety switch being selected from the group consisting of mechanical, electrical, electronic, voice actuated and photoelectric switches.

* * * * *